US008118554B1

(12) United States Patent
Liang

(10) Patent No.: US 8,118,554 B1
(45) Date of Patent: Feb. 21, 2012

(54) TURBINE VANE WITH ENDWALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 495 days.

(21) Appl. No.: 12/489,002

(22) Filed: Jun. 22, 2009

(51) Int. Cl.
*F01D 5/08* (2006.01)

(52) U.S. Cl. ..... 416/97 R

(58) Field of Classification Search ..... 415/115, 415/191; 416/96 R, 97 R, 193 A
See application file for complete search history.

(56) References Cited

U.S. PATENT DOCUMENTS 7,097,417 B2 * 8/2006 Liang ..... 415/115
7,621,718 B1 * 11/2009 Liang ..... 415/115
2008/0085190 A1 * 4/2008 Liang ..... 416/193 A
* cited by examiner

*Primary Examiner* — Edward Look
*Assistant Examiner* — Jason Davis
(74) *Attorney, Agent, or Firm* — John Ryznic

(57) ABSTRACT

A turbine stator vane with an outer endwall and an inner endwall, and with an airfoil extending between the two endwalls. The inner endwall includes an endwall edge with a plurality of slots each separated to form compartment slots. A number of impingement cooling holes discharge cooling an from a cooling air supply cavity into the compartment slots to produce impingement cooling for the backside wall of the endwall edge surface. A number of film cooling holes are connected to the compartment slots and discharge the spent impingement cooling an as a layer of film cooling air onto the outer surface of the endwall edge to counter act a bow wave hot gas flow and to provide cooling for the endwall edge to keep a low metal temperature and improve LCF for the vane.

3 Claims, 2 Drawing Sheets

TURBINE VANE WITH ENDWALL COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine vane.

2. Description of the Related Art including information disclosed under 37 CFR 1.97 and 1.98

A gas turbine engine, such as an industrial gas turbine (IGT) engine, includes a turbine with multiple rows or stages or stator vanes that guide a high temperature gas flow through adjacent rotors of rotor blades to produce mechanical power and drive a bypass fan, in the case of an aero engine, or an electric generator, in the case of an IGT. In both cases, the turbine is also used to drive the compressor.

It is well known that the efficiency of the engine can be increased by passing a higher temperature gas flow into the turbine. However, the turbine inlet temperature is limited to the material properties of the turbine parts, such as the first stage guide vanes and rotor blades. Also, the turbine inlet temperature is limited to an amount of cooling that can be produced on a turbine vane or blade. Improved cooling capability will also allow for the turbine airfoils to be exposed to higher temperatures. Improved cooling will also allow for longer part life which results in longer engine run times or longer periods between engine breakdowns.

Another problem with the turbines is hot flow ingestion into a section of the turbine that is sensitive to the high temperatures such as the rim cavities or interstage gaps. Bow wave driven hot gas flow ingestion is created when the hot gas core flow enters a vane row where a leading edge of the vane induces a local blockage and thus creates a circumferential pressure variation at an intersection of the airfoil leading edge location of the vane. The leading edge of a turbine vane generates upstream pressure variations which can lead to hot gas ingress into the front gap. The leading edge of the turbine stator vanes generates an upstream pressure that is higher than the pressure inside the cavity. FIG. 1 shows a prior art turbine vane with a bow wave effect located upstream of the turbine vanes. The high pressure upstream of the vane leading edge is greater than the pressure inside the cavity formed by the gap. As a result of the pressure differential, the hot gas will flow radially inward into the cavity. The ingested hot gas flows through the gap circumferentially inside the cavity towards the lower pressure zones. The hot gas then flows out at locations where the cavity pressure is higher than the local hot gas pressure.

In general, the size of the bow wave is a strong function of the vane leading edge diameter and distance of the vane leading edge to the endwall edge. The pressure variation in the tangential direction with the gap is sinusoidal. The amount of hot gas flow penetrating the axial gap increases linearly with the increasing axial gap width. It is therefore necessary to reduce the axial gap width to a minimum allowable by tolerance limits in order to reduce the hot gas ingress.

BRIEF SUMMARY OF THE INVENTION

It is an object of the present invention to provide for a turbine vane with an interstage gap in which the hot gas ingress into the gap is eliminated.

It is another object of the present invention to eliminate the ingress of hot gas flow caused by a differential pressure between the hot gas pressure and the cavity pressure from the bow-wave effect.

It is another object of the present invention to provide for a turbine stator vane with an endwall having a lower metal temperature in a bow wave region than in the prior art endwall.

It is another object of the present invention to provide for a turbine stator vane with an endwall having a much higher convective cooling than the backside impingement cooling method of the prior art.

These objectives and more can be achieved by the turbine vane with a directed cooling system in the airfoil leading edge section. The over-temperature caused by the bow wave ingress hot gas flow issued described above can be reduced or eliminated by the use of a directed cooling system into the airfoil leading edge section design of the vane. A backside impingement cooling in conjunction with multiple hole film cooling is used along a forward section of the airfoil leading edge root section. The multiple rows of film cooling holes is formed around the airfoil leading edge peripheral that will inject the film cooling air to form a film sub-layer for a baffle against the hot gas ingestion region from the downward draft of the hot core gas stream. Due to the cooling being inline with the endwall external heat load, the impingement onto the backside of the hot wall is then discharged as film cooling air will yield a very efficient method of cooling the hot wall surface.

The backside impingement and multiple hole film cooling circuit is formed around the airfoil leading edge root section at the endwall junction region by means of machining circumferential slots into the endwall. Impingement and film cooling holes are then machined into the inner and outer walls prior to welding a cap onto the edge of the cooling slot. The present embodiment retains an original design intent load path for the airfoil. The circumferential slots form multiple compartments that divide the endwall into multiple cooling zones. The multiple compartments of the endwall will minimize a pressure gradient effect for the cooling flow maldistribution. Micro pin fins are also used on the backside of the impingement cavity to enhance the convection cooling effect.

DETAILED DESCRIPTION OF THE INVENTION

Figure 1:
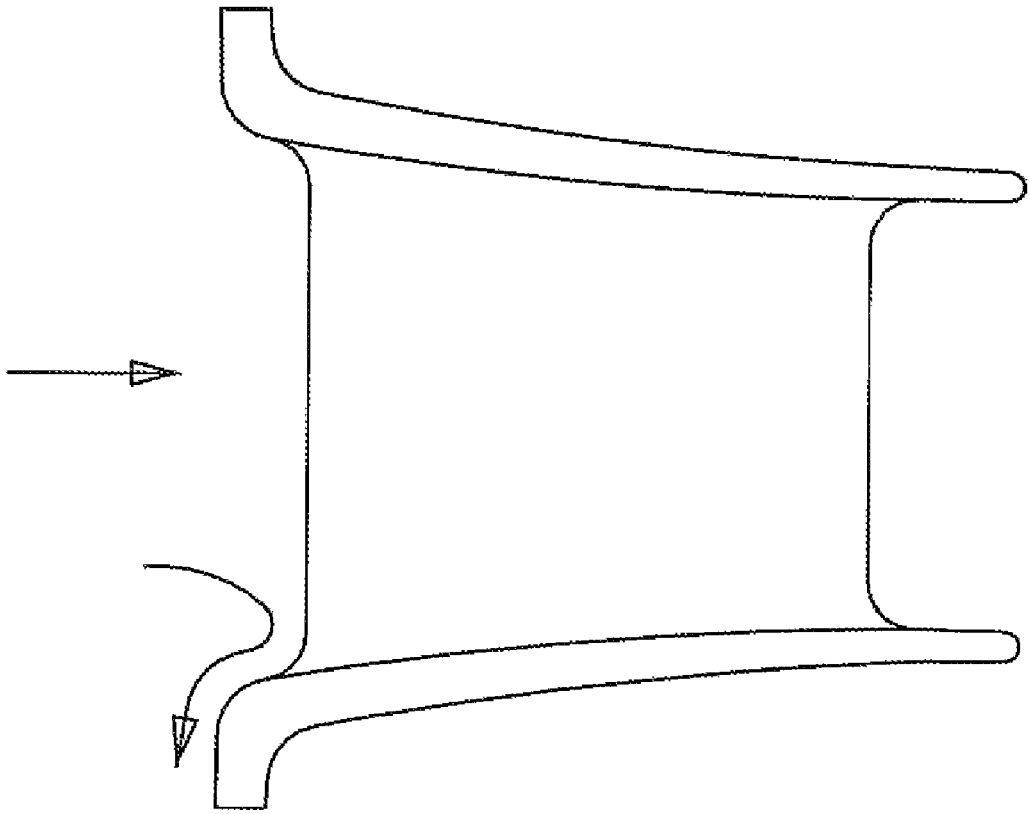
Fig 1 Prior Art
FIG. 1 shows a cross section side view of a prior art turbine stator vane with the hot gas flow pattern and hot gas ingress flow into the outer diameter endwall and inner diameter endwall of the vane.
Figure 2:
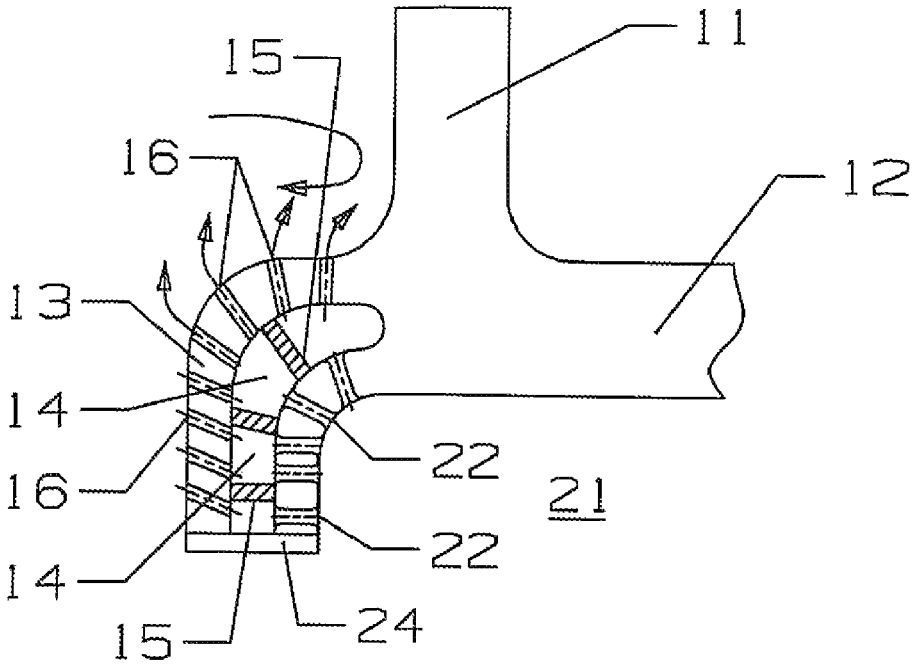
FIG. 2 shows cross section side view of a section of the vane endwall with the cooling circuit of the present invention.

The present invention is a turbine stator vane for an industrial gas turbine engine. However, the present invention is also usable in an aero engine stator vane as well FIG. 2 shows a cross section side view of a stator vane leading edge endwall with the cooling circuit of the present invention. The stator vane includes a leading edge 11 that extends from an outer endwall (not shown) to an inner endwall 12. The inner endwall 12 extends beyond the leading edge and curves downward to form the flow path for a hot gas flow that is passing through the turbine. This region is referred to as the endwall edge 13.

The endwall edge 13 includes an outer surface and an inner surface that forms a cooling air supply cavity 21. The endwall edge 13 includes a compartment slot or channel 14 that is machined from the endwall edge 13. A number of compartment divider ribs 15 separate a number of compartments 14 from each other. The inner surface includes a number of impingement holes 22 that connect the cooling air supply cavity 21 to the compartment slots 14. Each compartment slot 14 can have one row of impingement holes 22 or several rows of impingement holes 22. The outer endwall surface includes a number of film cooling holes 16 that connect the compartment slots 14 to the outer surface of the endwall edge and discharge film cooling air. A cover plate 24 is secured to a bottom of the rail of the endwall edge to enclose the compartment slots 14.

Figure 3:
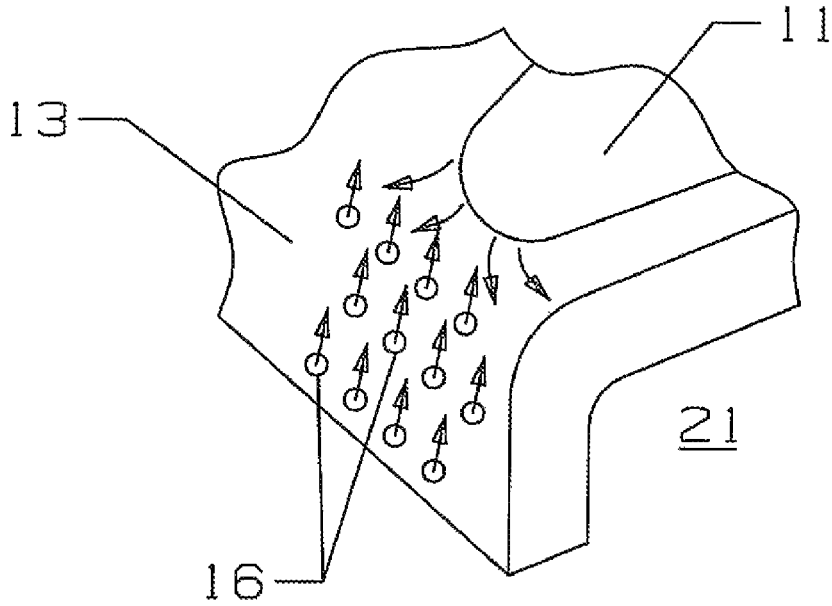
FIG. 3 shows an isometric view of a close up of the leading edge endwall of the vane in FIG. 2.

FIG. 3 shows an isometric view of the endwall edge 13 with an arrangement of the film cooling holes 16. The airfoil leading edge 11 is shown intersecting with the endwall edge 13, and the arrangement of film cooling holes 16 are shown in front of the leading edge and on the endwall edge that are all connected to the cooling air supply cavity 21. The arrows pointing toward the film cooling holes and away from the leading edge 11 represent the hot gas ingress flow. The arrows exiting from the film cooling holes 16 represent the film cooling air discharged. Micro pin fins can be used on the inner walls of the compartment slots 14 to enhance the heat transfer effect from the hot metal to the cooling air.

Pressurized cooling air supplied to the cooling air supply cavity 21 will flow through the impingement cooling holes 22 and into the compartment slots 14 to provide impingement cooling for the backside wall of the endwall edge 13 outer surface that is exposed to the hot gas flow. The spent impingement cooling air within the compartment slots 14 then flows out through the film cooling holes 16 to form a layer of film cooling air on the outer endwall surface. The film cooling air will push up the bow wave hot gas to reduce or eliminate the prior art effects described above.

Major design features and advantages of the endwall cooling circuit of the present invention over the prior art film blowing design are described below. The backside impingement in conjunction with multiple hole film cooling provides improved cooling along the bow wave region of the endwall. Film cooling holes on the bow wave section provides convective and film cooling for the airfoil endwall as well as to baffle the down draft hot gas core air for the vane leading edge. The ejected film cooling air will then migrate down to the airfoil endwall and provide purge air for the end gap of the endwall. The backside impingement cooling onto the backside of the hot wall with built in circumferential micro fins will generate a much higher convective cooling than the prior art backside impingement cooling method. Current cooling system increases the uniformity of the endwall region cooling and insulates the airfoil endwall structure from the passing hot core gas and thus establishes a durable airfoil cooling for the entire endwall and lowers the temperature for the airfoil endwall region. The multiple cooling hole at the bow wave region of the vane leading edge injects cooling air in line with the mainstream flow. This minimizes cooling losses or degradation of the film layer and therefore provides a more effective film cooling for the film layer formation. The multiple film cooling holes at the bow wave region of the endwall provides local film cooling all around the vane leading edge endwall location and thus greatly reduces the local metal temperature and improves the airfoil LCF (low cycle fatigue) capability. Micro fins used in the backside of the hot wall will enhance the bow wave region convective cooling and thus reduce the endwall section metal temperature that will then increase the airfoil ability.

I claim the following:

1. A stator vane for a turbine used in a gas turbine engine, the stator vane comprising:

an outer endwall and an inner endwall;

an airfoil extending between the outer endwall and the inner end wall;

the inner endwall having a forward endwall edge;

a cooling air supply cavity formed by the inner endwall;

the inner endwall edge having a slot extending from a lower side to an upper side near to a leading edge of the airfoil, a plurality of ribs to separate the endwall edge slot into a plurality of separate compartment slots;

a plurality of impingement cooling holes formed in the inner endwall edge to connect the cooling air supply cavity to the plurality of separate compartment slots; and, a plurality of film cooling holes formed in the inner endwall edge to connect the plurality of separate compartment slots to an outer surface of the inner endwall edge.

2. The stator vane of claim 1, and further comprising:

the plurality of film cooling holes extend from a lower side of the endwall edge to a top surface of the endwall edge just before a start of a fillet formed between the endwall edge surface and the airfoil leading edge.

3. The stator vane of claim 2, and further comprising:

the plurality of film cooling holes are each directed to discharge film cooling air upwards toward the airfoil leading edge.

* * * * *